United States Patent [19]

Mihelich

[11] Patent Number: 4,540,029

[45] Date of Patent: Sep. 10, 1985

[54] WIRE COIL PRODUCTION SYSTEM

[75] Inventor: Peter Mihelich, Farmingdale, N.Y.

[73] Assignee: Grumman Aerospace Corporation, Bethpage, N.Y.

[21] Appl. No.: 675,757

[22] Filed: Nov. 28, 1984

Related U.S. Application Data

[63] Continuation of Ser. No. 454,364, Dec. 29, 1982, abandoned.

[51] Int. Cl.[3] ..... B21F 3/04

[52] U.S. Cl. ..... 140/92.2; 242/7.09; 242/35.5 T

[58] Field of Search ..... 140/92.2; 242/7.09, 242/35.5 T

[56] References Cited

U.S. PATENT DOCUMENTS

| | | | |
|---|---|---|---|
| 2,177,311 | 10/1939 | Weimer . | |
| 2,246,608 | 6/1941 | Taylor et al. | 140/92.2 |
| 2,279,323 | 4/1942 | Johnson et al. | 140/92.2 |
| 2,781,179 | 2/1957 | O'Malley . | |
| 2,888,214 | 5/1959 | Wilke . | |
| 2,984,425 | 5/1961 | Thayer . | |
| 2,985,401 | 5/1961 | Gazet . | |
| 2,986,352 | 5/1961 | Dumbauld | 242/7.09 |
| 3,086,725 | 4/1963 | Zernov . | |
| 3,136,493 | 6/1964 | Swanson . | |
| 3,148,563 | 9/1964 | Harley et al. | 72/5 |
| 3,152,768 | 10/1964 | Astrom . | |
| 3,439,882 | 4/1969 | Woodrow et al. . | |
| 3,583,650 | 6/1971 | Zaborovsky . | |
| 3,598,333 | 8/1971 | Beeman et al. . | |
| 3,945,580 | 3/1976 | Veyrassat . | |
| 3,985,313 | 10/1976 | Klein et al. . | |
| 4,121,627 | 10/1978 | Schmid . | |
| 4,147,310 | 4/1979 | Harden et al. . | |

FOREIGN PATENT DOCUMENTS

| | | | |
|---|---|---|---|
| 1040690 | 10/1958 | Fed. Rep. of Germany | 242/7.09 |

*Primary Examiner*—Lowell A. Larson

*Attorney, Agent, or Firm*—Richard G. Geib

[57] ABSTRACT

A wire coil production system is disclosed for winding, tieing and distributing coils fabricated from pre-cut wire segments. Four controllably driven mandrels or reels are mounted in relative quadrature on a rotatable turret which cycles each mandrel through stations for (1) receiving the wire and initiating the winding operation, (2) completing the winding operation, (3) tieing the formed coil and (4) discharging the coil to a conveyor/-distributor system. Each mandrel includes a wire sensor, and automatic wire clamping and coil load/unload mechanisms. A control system coordinates all operations so they are synchronized with the wire feed system and with each other.

6 Claims, 11 Drawing Figures

WIRE COIL PRODUCTION SYSTEM

This is a continuation of application Ser. No. 454,364 filed Dec. 29, 1982 now abandoned.

This invention relates to equipment and processes for automatically fabricating coils of wires from wire segments received from a wire processing system and sorting and delivering the finished coils.

There are a wide variety of wire coiling systems directed at automating one or more phases of the coiling process to increase throughout. One common approach is to use multiple spool or multiple mandrel heads often mounted on a rotatable turret and indexed through various stations for loading, winding, and discharging the coils.

Generally speaking these systems coordinate the various station functions so that loading of one mandrel is completed at the winding station before winding of the next coil in the sequence begins. Often the system is fed from one continuous supply of wire and the severing of the feed from the fully loaded mandrel also plays a role in engaging the severed feed end to the next mandrel or spool to be loaded.

While a fair degree of automation is achieved with the foregoing arrangements, their construction and modes of operation do not lend themselves to the continuous winding and tieing of pre-cut wires, which may be of varying lengths, at throughputs which match the primary wire segment forming process.

It is accordingly an object of the invention to fabricate wound and tied wire coils of varying lengths at high production rates. Another object is to implement this production for smooth coordination with wire processing, and coil sorting and transporting mechanisms. Still another object is to reduce the interdependence between system modes of operation which has heretofore characterized many approaches, thereby reducing constraints on optimizing system operation. Other objects include improving the engaging winding, tieing and discharge functions and improving the control system for these and other process parameters.

SUMMARY OF THE INVENTION

The foregoing and other objects are achieved by a coil production system which includes (1) a set of rotatable mandrels, each having (a) wire sensing means, (b) means for engaging a pre-cut feed wire, (c) means for constraining the wire in a coiled configuration as it is wound and (d) means for discharging the wire after the winding operation is completed; (2) controllable mandrel drive means for rotating each mandrel during certain phases of the coil forming operation; (3) feeding, coiling and discharge stations; (4) indexing means for moving each mandrel successively past the feeding, coiling and discharge stations and (5) a control system for controlling the mandrel drive control, the indexing mechanism and the feeding, coiling and discharge stations such that engaging, coiling and discharging operations are carried out concurrently to provide continuous production of coils.

DESCRIPTION OF THE DRAWINGS

Serving to illustrate an exemplary embodiment of the invention are the drawings of which.

GENERAL CONFIGURATION

Figure 1:
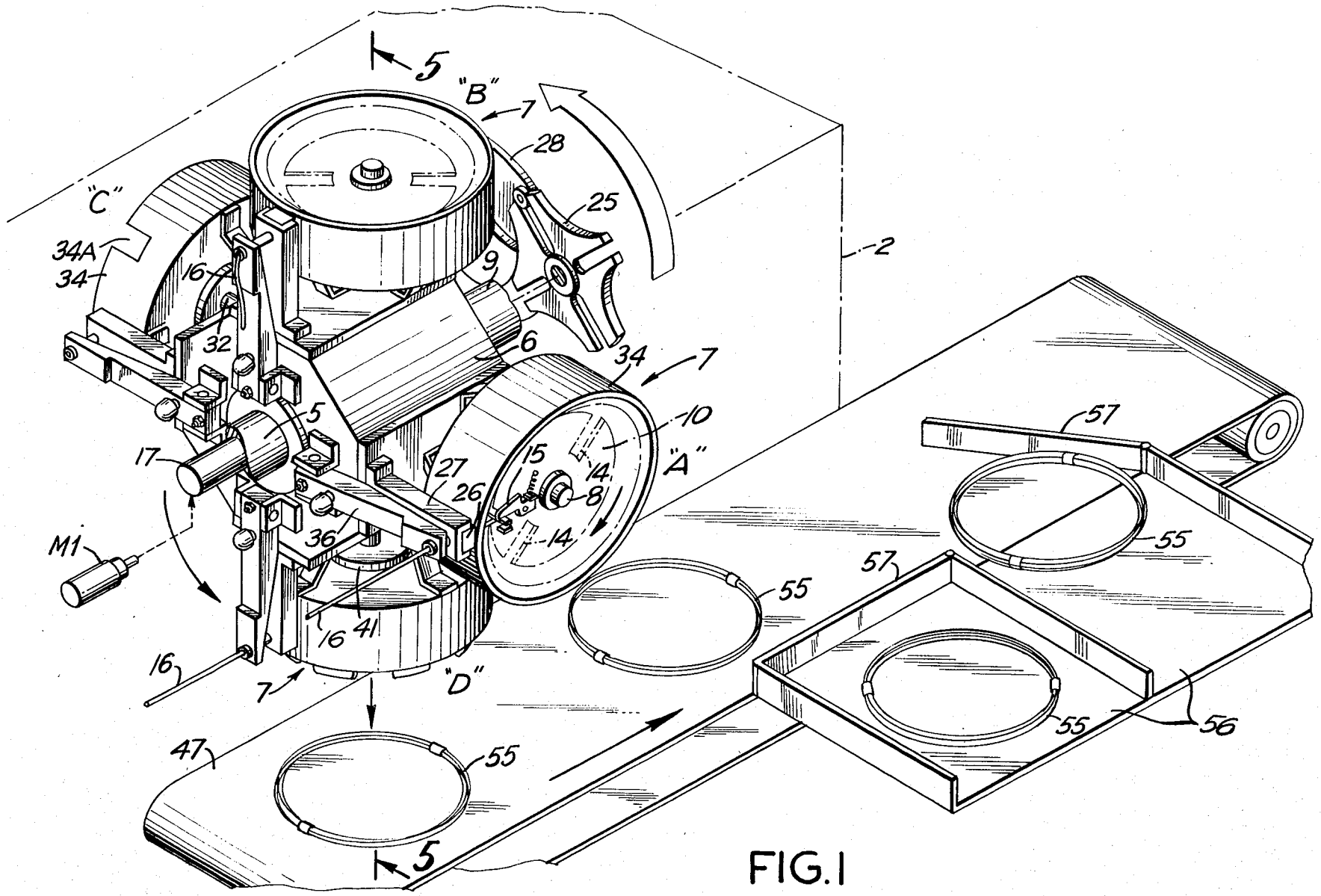
FIG. 1 is a perspective and partially schematic view of a coil production system.

The illustrative embodiment employs four identical mandrel assemblies 7, FIG. 1, each rotatably mounted on a turret 6. Shaft extensions 5 and 9 of the turret facilitate its rotation relative to the machine frame 2 as will subsequently be described. The entire system including frame, turret and motor drives is mounted in a movable assembly which can be positioned relative to wire processing and coil distributing sites.

The mandrels 7 are rotatably driven for coil winding operations by a servo-controlled motor M1 which through a shaft 17 coaxial with axle 5, and a transmission system within turret 6, drives the mandrels during certain phases of operation.

A pre-cut wire segment 16 to be coiled is ejected from a wire processing unit, not shown, which may be a wire marker machine, a stripper etc. and is fed to each mandrel 7 in turn via a guide system which includes a threading die 36 and wire sensing unit 26,27. After passing through the sensor, the leading end of the wire passes through a cutout in mandrel housing 34 and engages a wire clamp 15 on plate 10 of the mandrel.

When the presence of a wire is detected by the sensor 26,27, a control action is initiated which causes the respective mandrel to become engaged with drive shaft 17 causing it to rotate. This rotation causes clamp 15 on each reel to clamp the leading end of the respective feed wire. Coiling then commences.

As the coiling operation commences an indexing function occurs with each mandrel being displaced to the adjacent quadrant. The mandrel at position A for example is rotated to a position "B", FIG. 1, simultaneously carrying its feed wire with it and continuing its winding operation. The mandrel and its coil at position "B" moves to "C" in preparation for discharge. The now-empty reel assembly at position "D" moves into the "A" position in readiness to receive the next feed wire. This is accomplished with an indexing mechanism 25,28 coupled to axle 9 for rotating turret 6.

When the trailing end of the wire being coiled at the mandrel (which is now at position B) passes through the respective sensor 26,27, the mandrel is disengaged from drive shaft 17 and winding stops.

During the following indexing operation, the reel is rotated to position C where the wire coil is tied. It is then indexed to position D where the coiled and tied wire 55 is discharged to a conveyor 47 which delivers it to one of the discharge bins 56, via a respective deflector gate 57.

These operations are carried on continuously and automatically as pre-cut wire segments are fed to the machine; they are engaged, wound, tied, and delivered by the system to the conveyor.

MANDRELS

Figure 2:
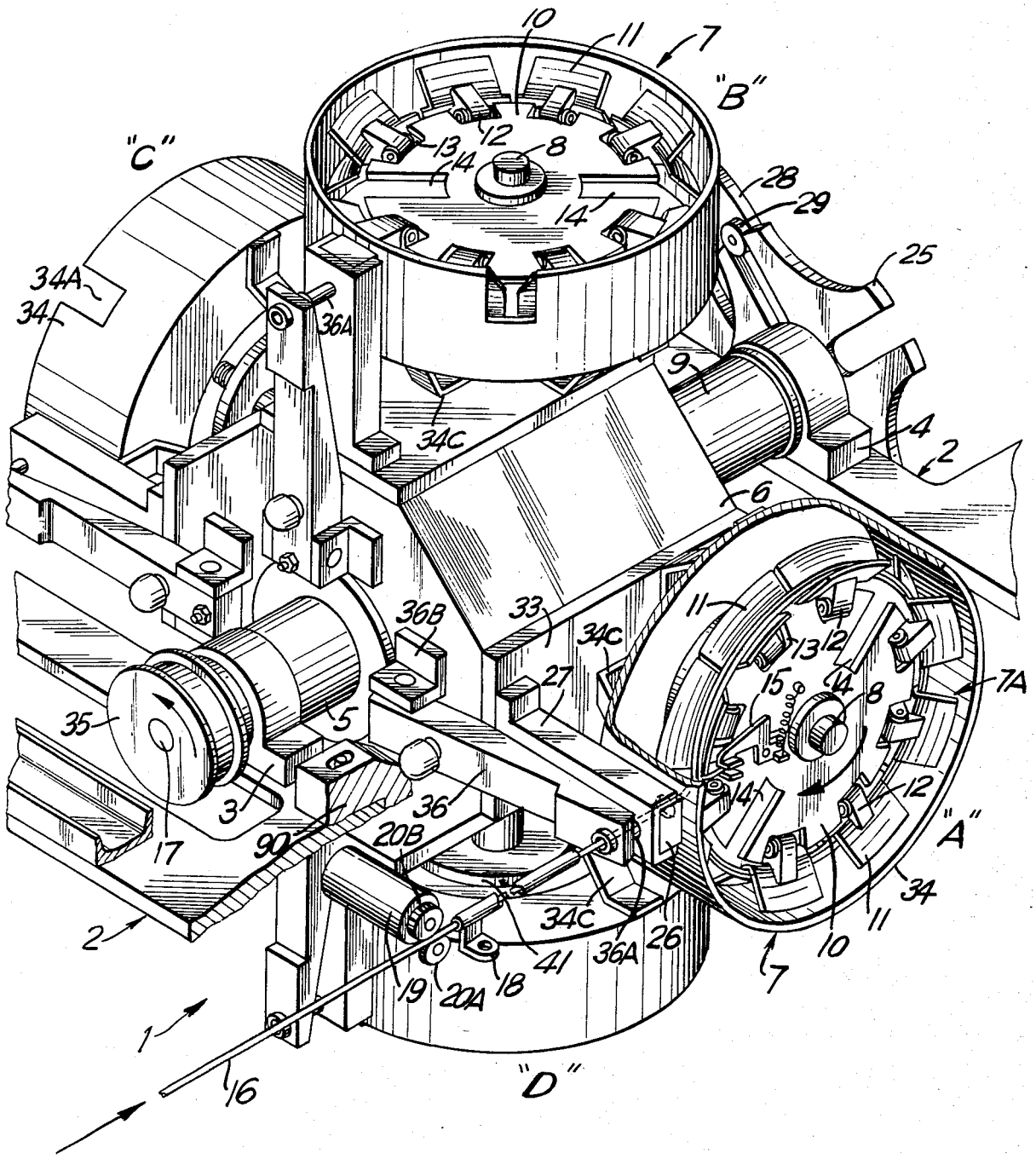
FIGS. 2, 3 and 4 are perspective views on an enlarged scale of the turret and mandrel assemblies of the system illustrating various phases of system operation.
Figure 3:
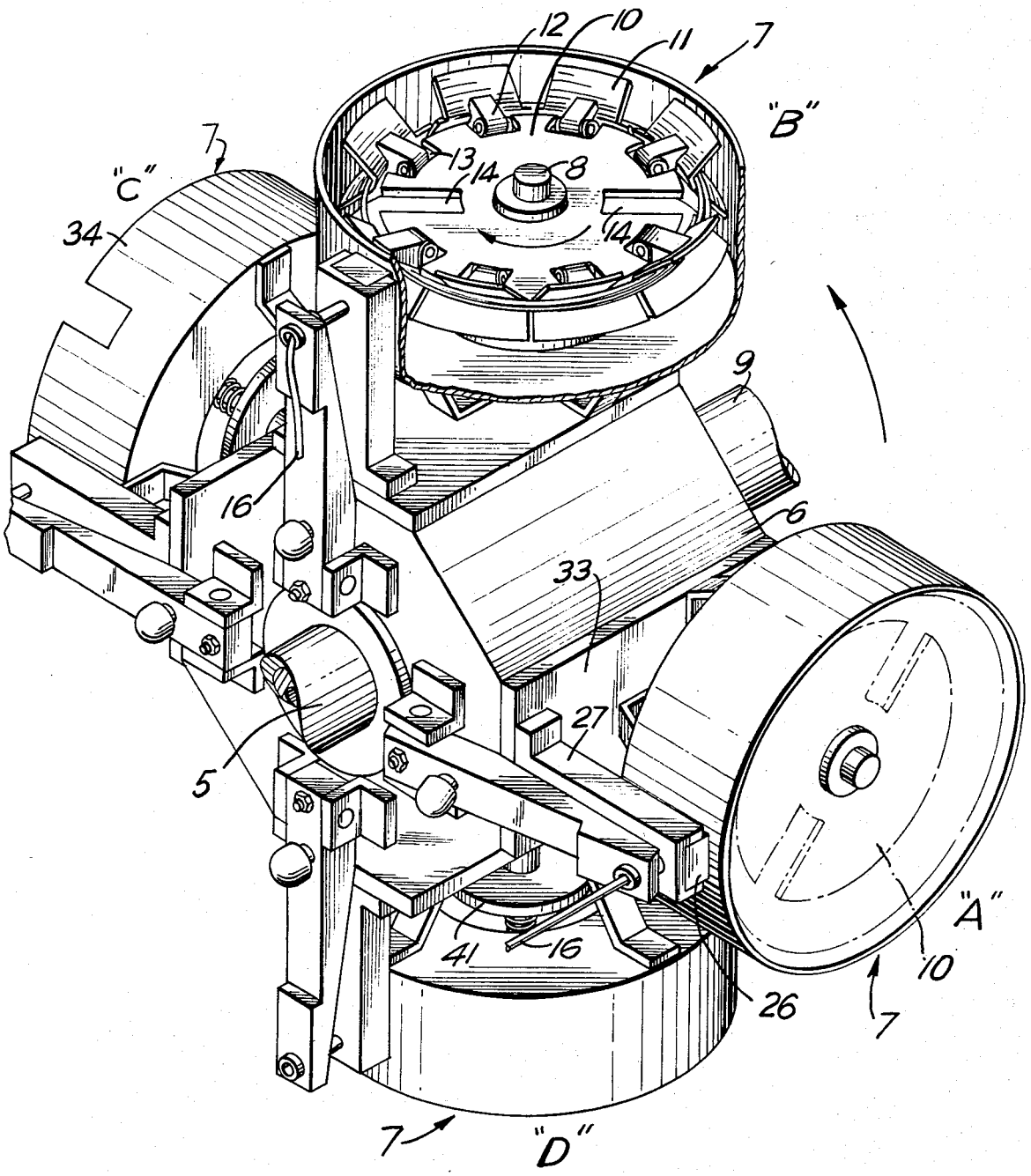

As shown in detail in FIG. 2, a length of wire 16 is guided to the mandrel 7 at the wire feed station with the aid of a pair of rollers 20A, 20B and the threading die 36 which directs the wire through sensor 26,27 and an aperture in the reel casing 34 to the rotor assembly of the mandrel. To this end, each die 36 is pivotally mounted on the turret between a pair of flanges 36B and has a wire guide tube 36A at its opposite end. A cam 90 at the feed station rocks the die arriving at that station causing tube 36A to pass through the sensor 26,27, and the mandrel housing 34 to provide a conduit for guiding the wire into the mandrel rotor assembly.

Each of these assemblies includes a circular plate 10 mounted on a spindle 32 having a cap nut 80. Each plate has a serrated periphery, in the notches of which are pivotally mounted V-shaped rim segments 11. The latter are distributed around the periphery of plate 10 to define a concave wire engaging surface.

Figure 5:
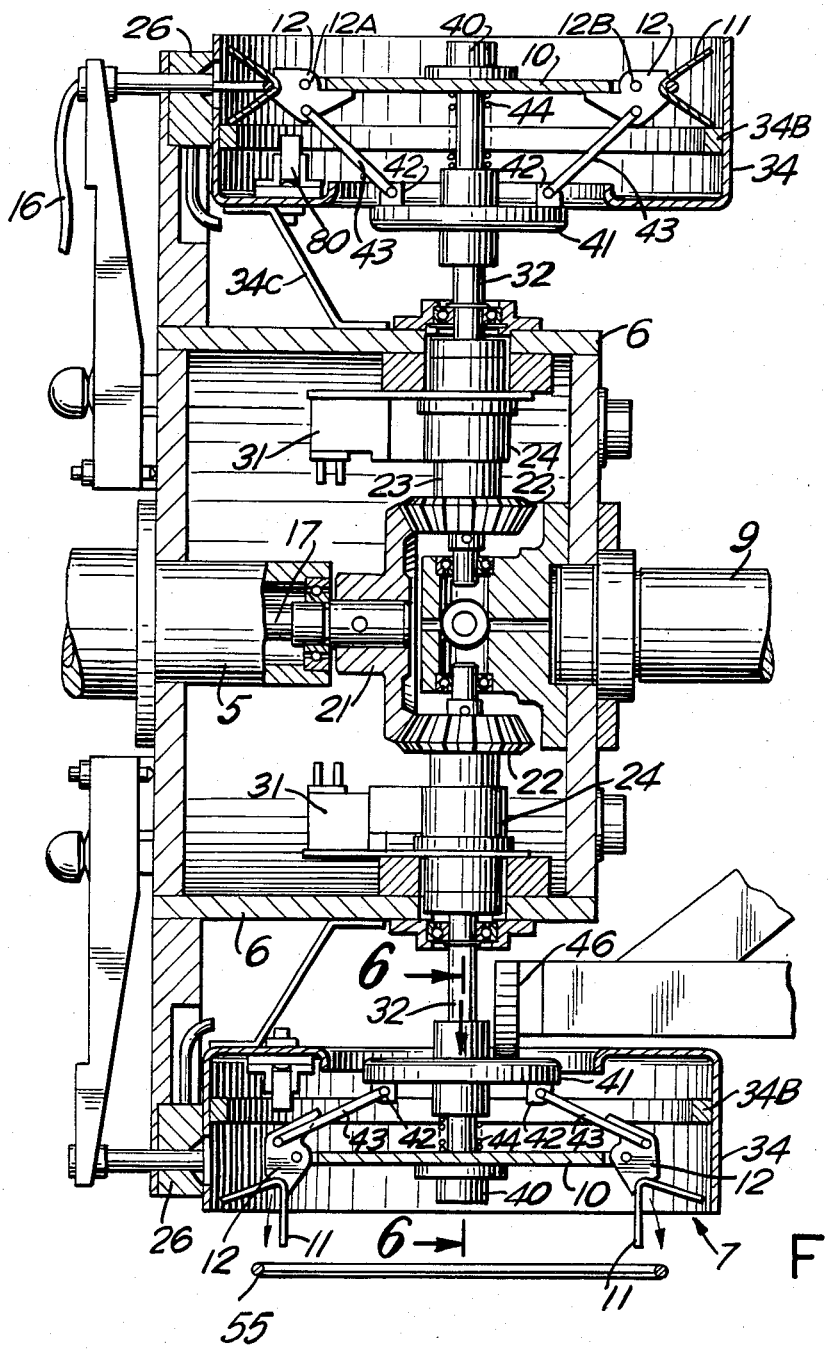
FIG. 5 is an elevational and cross-sectional view taken along the lines of 5—5 FIG. 1.

This surface is located within the associated mandrel housing 34 with the inwardly located leg of each rim bearing against a flange 34B, FIG. 5, fixed to the housing. Each housing is secured to turret 6 with brackets 34C.

The peripheral rim segments 11 are each secured to a fitting 12, FIGS. 2, 5, pivotally mounted on a respective pin 12A which bridges each notch in plate 10.

In the winding and tieing modes each fitting assembly 11, 12 is positioned as shown in FIG. 2 and in the upper mandrel of FIG. 5. This positioning is controlled by a cam follower 41 on spindle 32 of each mandrel and a respective spring 44 which urges the cam in a radially inward direction. Links 43 interconnect the follower and each rim assembly 11, 12 thereby maintaining the latter with their stops 12B against plate 10.

This coil engaging position is changed when the mandrel arrives at the discharge station shown at the bottom of FIG. 5. For this purpose a cam 46 is provided on the machine frame 2 to displace the arriving follower 41 outwardly against its associated spring 44.

Figure 6:
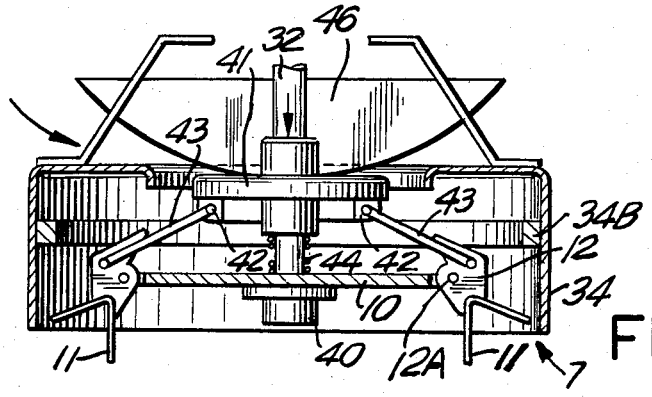
FIG. 6 is an elevational and cross-sectional view taken along the lines of 6—6 FIG. 5.

As this occurs, the actuator links 43 eccentrically rotate their respective rim assemblies 11, 12 to the position shown in FIG. 5 (bottom mandrel) and in FIG. 6, releasing the wire clamp as described in the next section and permitting the wound and tied coil to slide off the mandrel and on to the conveyor 47. When the mandrel is thereafter indexed to the feed station "A", spring 44 causes follower 41 to retract and the rim assemblies 11, 12 to return to the wire engaging position.

MANDREL WIRE CLAMP

Figure 9:
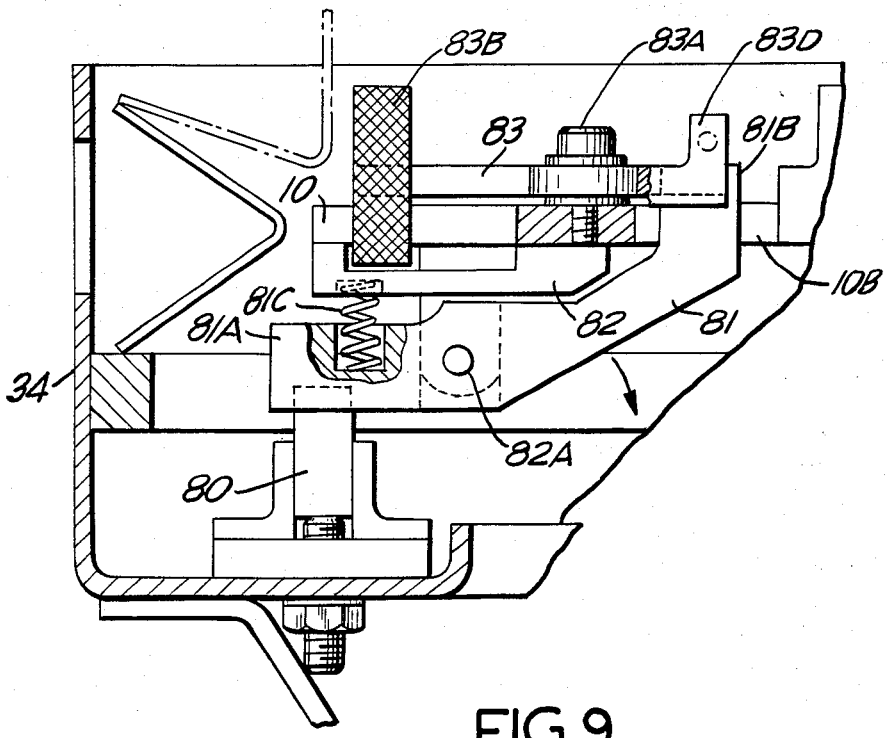
FIGS. 9 and 10 are fragmentary elevation and plan views, respectively, of one mandrel with its wire clamping and reset mechanisms.
Figure 10:
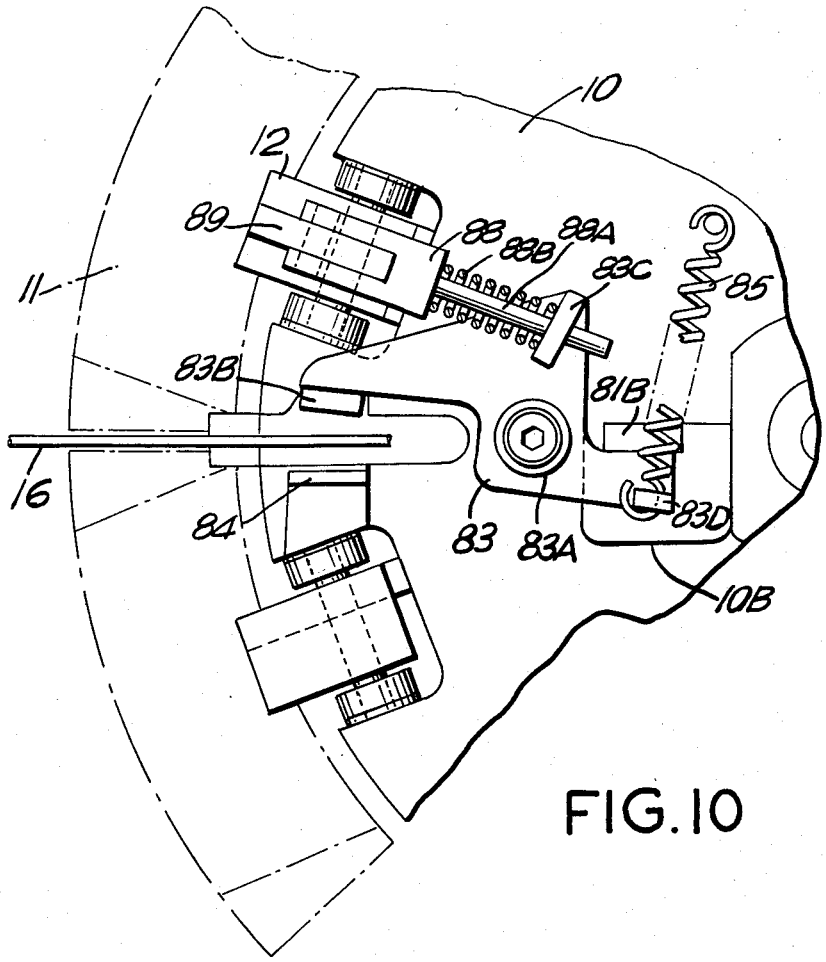

A wire clamp lever 83, FIGS. 9, 10, is pivotally mounted on each mandrel plate 10 with pivot assembly 83A. The outer end of lever clamp 83 includes a clamping surface 83B which is in facing relationship to a stop 84, FIG. 10, fixed to plate 10.

In the position shown the facing surfaces of stop 84 and lever clamp 83 are separated to receive a wire end 16 fed to the mandrel. When rotation of the mandrel commences lever 83 is tripped and its clamping end 83B moves toward stop 84 to thereby clamp the wire end.

This tripping is accomplished with a cam and follower arrangement which includes a cam 80, FIG. 9, mounted on the associated housing 34 below the respective plate 10. The cam is engaged by the cam follower leg 81A of a latch 81. The latch is pivotally mounted to plate 10 with a clevis 82 having a pivot pin 82A. A section 83B of latch 81 extends through an aperture 10B in plate 10 and engages the wire clamp lever 83. A spring 81C urges the latch towards contact with the cam surface 80.

When rotation of the mandrel from its reset position begins, follower 81A rides up on cam 80; its end 81B moves downward, FIG. 9, and out of engagement with clamp lever 83. At this point a spring 85, FIG. 10, connected between plate 10 and a tab 83D on lever 83, pulls the clamp lever into the wire engaging position.

For resetting the clamp, a clevis 88 is pivotally mounted on a tab 89 integral with one of the rim assemblies 12 and includes a shank 88A which passes through a hole in a tab 83C on lever clamp 83. A spring 88B on shank 88A resiliently separates the lever clamp and rim assembly.

When the illustrated mandrel arrives at the discharge station, the rim assemblies 11,12 are pivoted as previously explained. This action causes clevis 88 and its shank 88B to rock lever clamp 83 into its release position, thereby releasing the wire end. When this occurs, latch section 81B, previously blocked by lever 83, moves upward through hole 10B to assume its reset position and to hold clamp 83 in its cocked position in preparation for the next clamping action.

MANDREL DRIVE SYSTEM

The motor M1, FIG. 1, supplies drive for the mandrels via a pulley and belt system, the driven pulley 35 of which is fixed to main drive shaft 17, FIG. 2. As described in a following section, motor M1 is controlled by the tachometer-generator 19.

As shown in FIG. 5, shaft 17 is journaled in axle 5 and drives a master bevel gear 21. The latter drives a set of four planetary bevel gears 22, one for each mandrel.

Each gear 22 is connected to a clutch assembly 23,24, the output of which is connected to the respective spindle 32. Each clutch is controlled in turn by a switching unit 31, which is responsive to the associated wire sensors 26,27. When the presence of a wire is detected, switch unit 31 causes the clutching system to clutch shaft 32 to driven gear 22 thereby causing rotation of the mandrel to commence.

COIL TIEING

Figure 4:
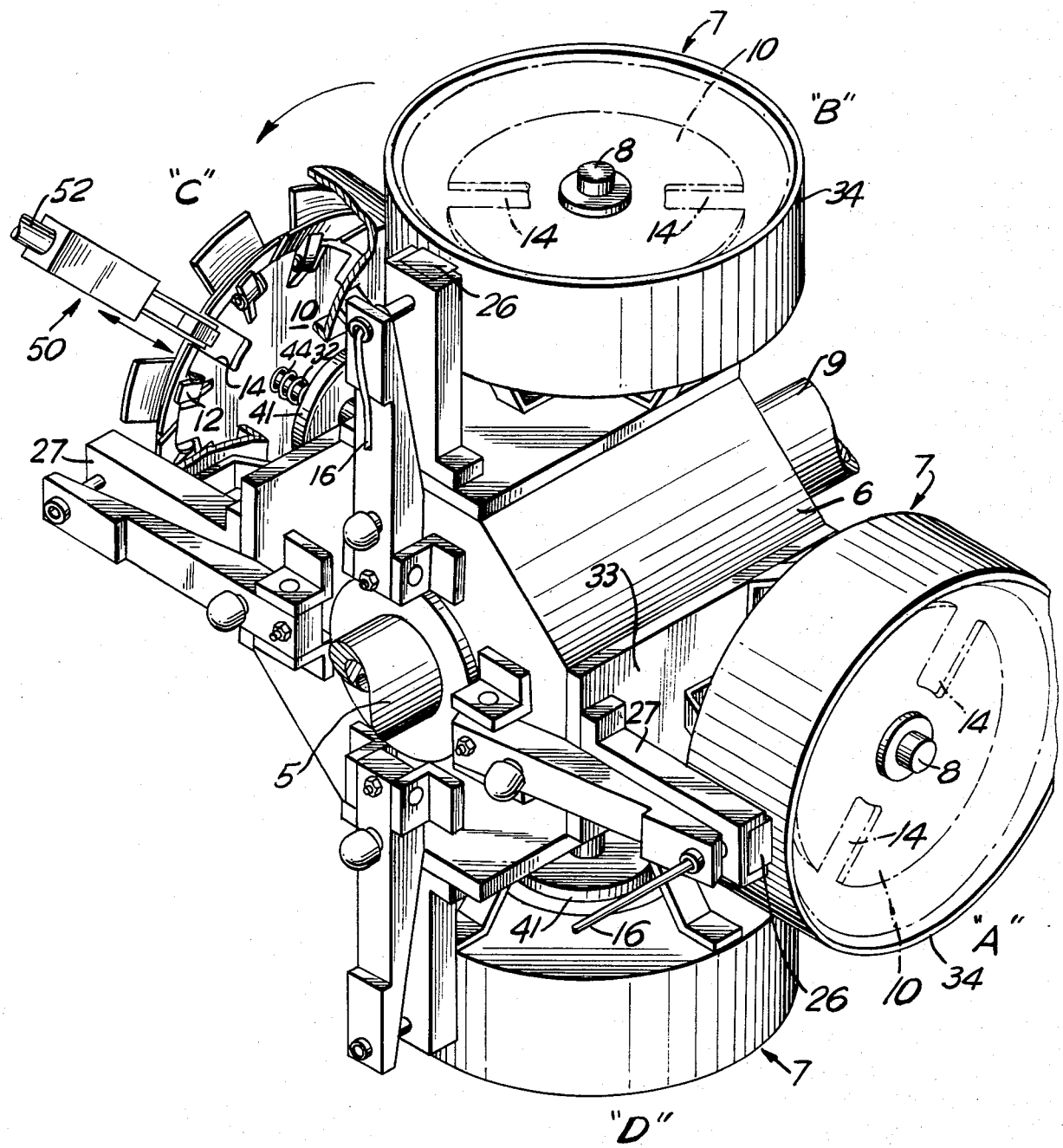
Figure 8:
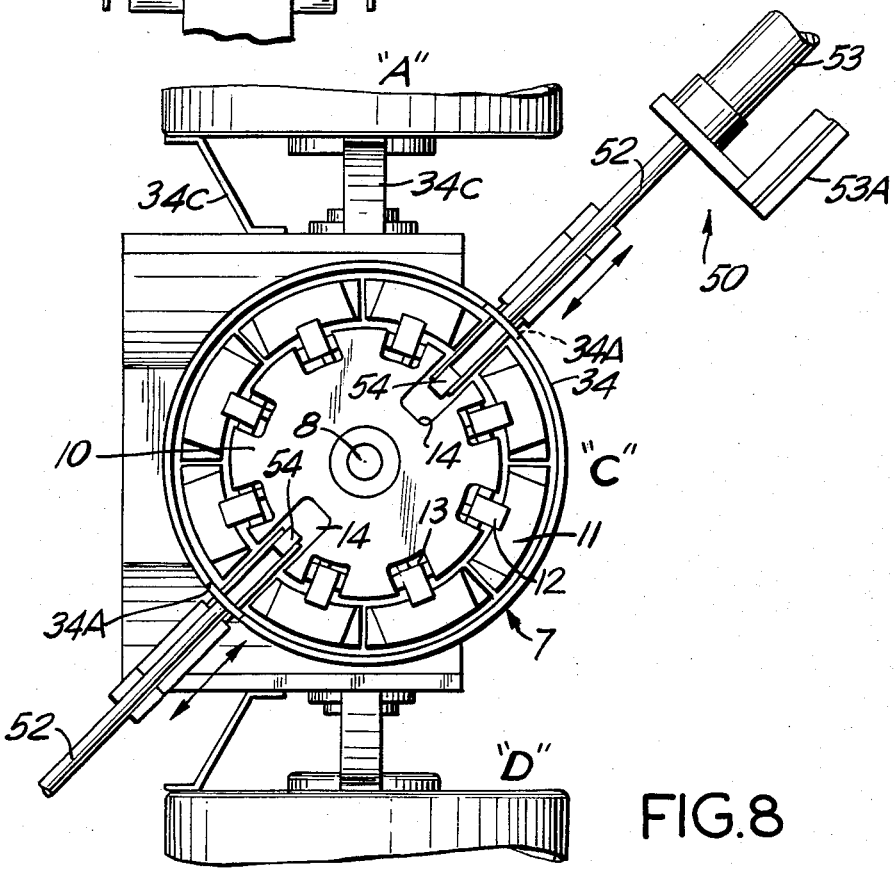
FIG. 8 is an elevational and partially fragmentary view of the mandrel located at the tieing station.

As each mandrel with its coil of wire moves from position B, FIG. 1, to position C, coil tieing operation is initiated. For this purpose, the tieing section at location C includes a pair of diametrically opposed tieing mechanisms embodies as hydraulic actuators 50, FIG. 4 and FIG. 8. Each includes a hydraulic cyclinder 53 mounted on bracket 53A secured to the machine frame 2. Each cylinder actuates a piston rod 52, to the distal end of which is connected an applicator 54. Under the control of a valve system, not shown, each piston rod 52 moves inwardly toward the coil of wire with its applicator 54 passing through cutouts 34A in housing 34 to loop a tie or tag around the wire coil. To provide clearance for this action, the rim assemblies 11,12 which are otherwise equally spaced, include two pairs with greater spacing to accommodate cutouts 14 in plate 10. The rods 52 then retract, pulling the applicators 54 outside and clear of the mandrel housing 34.

When the tieing or tagging operation is completed, an indexing step occurs which moves the tied coil to the discharge station D and brings a new coil to station C for the tieing operation.

INDEXING

Figure 7:
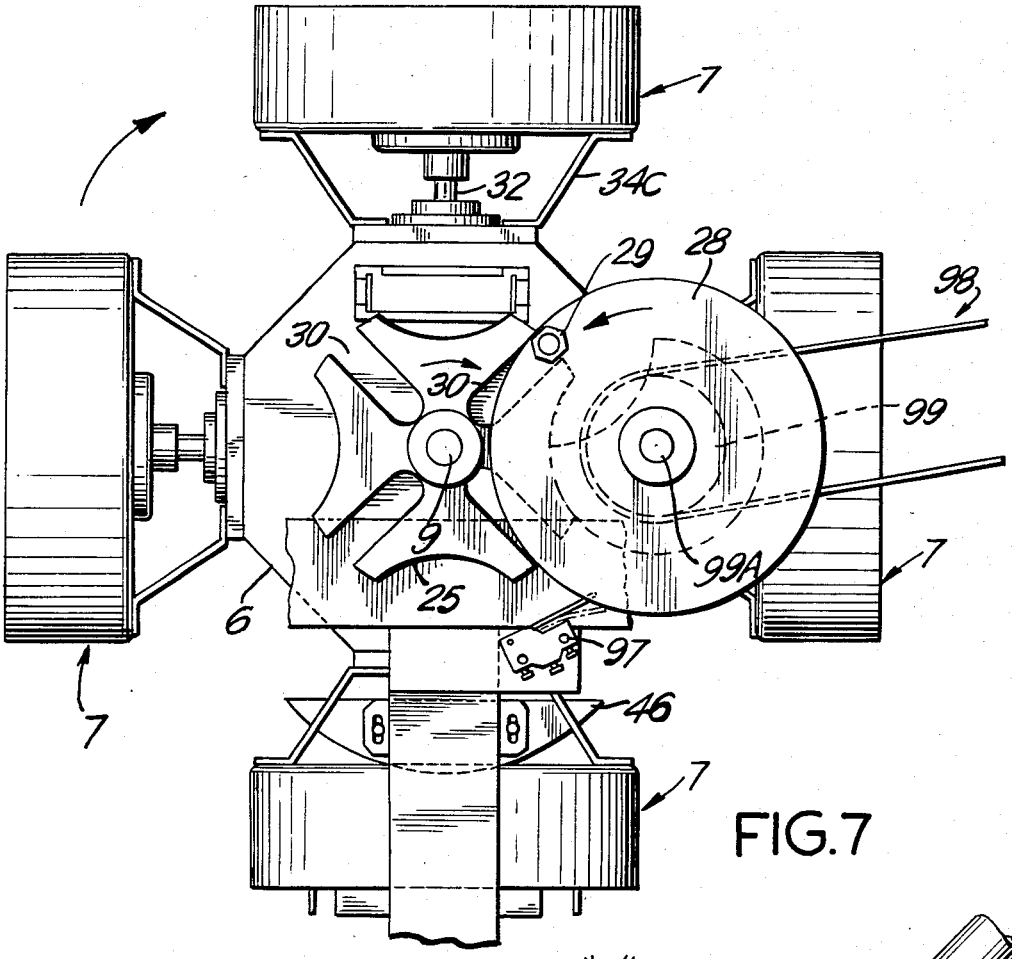
FIG. 7 is an elevational view of the turret and mandrel assemblies viewed from the indexing side.

Each time a mandrel engages a wire segment and begins its coiling operation, the turret 6 is indexed 90°. This operation is initiated by each wire sensing unit when it senses the presence of a new wire segment. A motor M2 responds to this signal via a motor control unit 95, FIG. 11, driving through a belt and pulley system 98,99, FIG. 7, a geneva mechanism which includes a rotor 28 fixed to shaft 99A carrying pulley 99. The rotor includes an eccentric pin 29 which is positioned to engage slots 30 in geneva wheel 25. The latter is fixed to axle 9 of the turret 6.

Each time motor M2 is energized, rotor 28 rotates geneva wheel 25 through 90° to provide the indexing action. A microswitch 97 is tripped after each 90° displacement to provide an appropriate control signal to motor M2.

CONTROL SYSTEM

Figure 11:
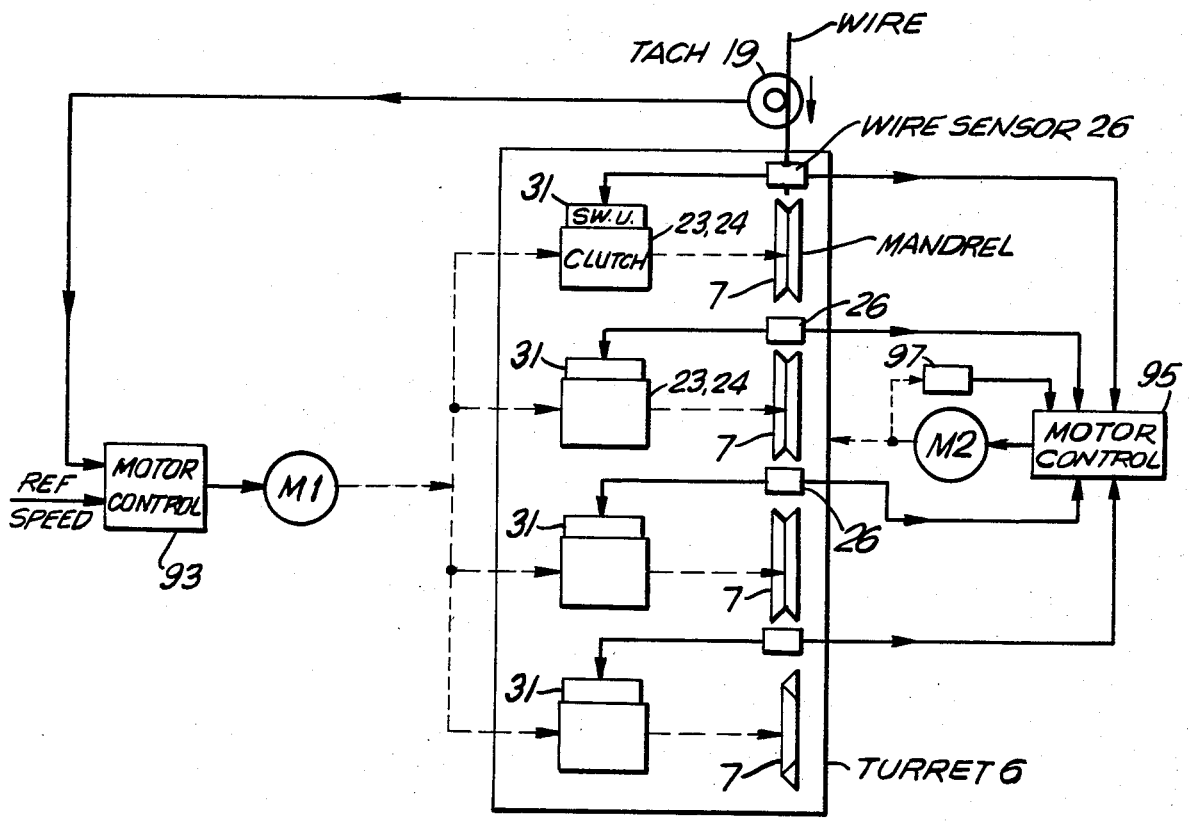
FIG. 11 is a schematic diagram of the control system.

Control over the operation of the system is schematically indicated in FIG. 11. Motor M1 provides drive to each of the mandrels 7 via the respective clutch units 23,24 and their associated switching unit 31. Each time a wire traverses a wire sensor 26, the associated clutch is energized causing motor M1 to drive the mandrel to which it is connected. Control over the speed of motor M1 is provided by feedback tachometer 19, also shown in FIG. 2, whose signal is compared with a reference speed signal supplied to motor control 93.

During the wire engaging interval, a wire sensing signal is coupled from the involved wire sensor to motor control 95 which responds by actuating M2 to initiate an indexing operation. Completion of the resultant quadrature displacement momentarily actuates the switch 97. Motor control 95 responds by deenergizing motor M2.

In a preferred embodiment, the motor control system is embodied as a microprocessor based programmable controller, which in addition to receiving the inputs shown in FIG. 11 also receives inputs from sensors which detect whether the mandrels in position B have stopped rotating and whether the coil tieing actuators 50 are retracted. These additional inputs insure that indexing occurs after a wire has been seized for coiling but only provided that the mandrel at station B is stationary and the coil tieing actuators are engaged and clear of the mandrel at station C.

What is claimed is:

1. A wire coiling production system comprising:

(1) a set of rotatable mandrels, each having (a) wire sensing means, (b) means for engaging a pre-cut feed wire from a single source of wire, (c) means for constraining the wire in a coiled configuration as it is wound on said mandrels which are controlled by the beginning and end of each pre-cut feed wire fed into said system and (d) means for discharging the coil as a free-form coil after the winding operation is completed;

(2) controllable mandrel drive means for rotating each mandrel during certain phases of the coil-forming operation;

(3) feeding, winding and discharge stations;

(4) indexing means for moving each mandrel successively past the feeding, winding and discharge stations; and (5) a control system for controlling the mandrel drive control, the indexing mechanism and the feeding, winding and discharge stations controlled by the leading and trailing ends of each pre-cut feed wire fed into said production system such that operations carried out at each station are coordinated to continuously, simultaneously and successively produce wound free-form coils.

2. The apparatus of claim 1 including a tieing station located between said winding and discharge stations provided with means for imparting contraints to the wound coils.

3. The apparatus of claim 2 wherein said control system provides concurrent coiling, tieing and discharge operations at said stations.

4. A coil forming process comprising steps of:

(1) providing a plurality of successive wire segments from a single source of wire;

(2) engaging a first wire segment at a first station and initiating the coiling thereof;

(3) spacially displacing said partially coiled first segment to a second station for the further winding thereof;

(4) engaging a second wire segment at said first station and commencing the coiling thereof;

(5) spacially transporting said coiled first segment to a third station and said second wire to said second station where coiling is completed;

(6) engaging a third wire segment at said first station; and (7) cyclically repeating the above steps with succeeding wire segments to provide a continuous supply of coils while controlling the cyclic repetition of said steps by sensing the leading and trailing ends of each pre-cut feed wire fed into said process, coordinating said steps continuously, simultaneously and successively and producing wound free-form coils.

5. The process of claim 4 including the step of applying restraining means to the coils after they are wound.

6. The process of claims 4 or 5 including the step of discharging a wound coil while the winding of other coils are in process.

* * * * *